US010315083B1

(12) United States Patent
Moreira et al.

(10) Patent No.: US 10,315,083 B1
(45) Date of Patent: Jun. 11, 2019

(54) GOLF CLUB GRIP

(71) Applicant: Cobra Golf Incorporated, Carlsbad, CA (US)

(72) Inventors: Scott H. Moreira, Vista, CA (US); Michael S. Yagley, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 0 days.

(21) Appl. No.: 15/806,656

(22) Filed: Nov. 8, 2017

(51) Int. Cl.
*A63B 53/14* (2015.01)
*A63B 47/02* (2006.01)
*A63B 60/14* (2015.01)

(52) U.S. Cl.
CPC ..... *A63B 60/14* (2015.10); *A63B 53/14* (2013.01); *A63B 47/02* (2013.01)

(58) Field of Classification Search
CPC ..... A63B 60/14; A63B 53/14; A63B 60/00; A63B 60/024; A63B 47/02
See application file for complete search history.

(56) References Cited

U.S. PATENT DOCUMENTS 2,782,035 A * 2/1957 East ..... A63B 60/24 473/297
4,017,082 A * 4/1977 Channing ..... A63B 57/353 473/285
4,380,337 A * 4/1983 DiMatteo ..... A63B 57/353 473/285
4,674,746 A * 6/1987 Benoit ..... A63B 60/24 30/308.1
4,822,052 A * 4/1989 Dimmick ..... A63B 49/08 473/285
4,887,815 A * 12/1989 Hughes ..... A63B 53/00 473/291
4,936,586 A * 6/1990 Van Raemdonck ... A63B 49/08 473/519
4,988,102 A * 1/1991 Reisner ..... A63B 60/24 473/297
5,244,209 A * 9/1993 Benzel ..... A63B 60/24 473/297
5,465,967 A * 11/1995 Boeckenhaupt ..... A63B 60/24 473/297
5,571,051 A * 11/1996 Huang ..... A63B 49/08 473/302
5,813,920 A * 9/1998 Rife ..... A63B 60/14 473/300
6,419,601 B1 * 7/2002 Kenner ..... A63B 49/08 473/552
6,852,040 B1 * 2/2005 Williams ..... A63B 47/02 473/286
7,399,235 B2 * 7/2008 Gill ..... A01K 87/08 473/297
7,481,716 B1 * 1/2009 Johnson ..... A63B 60/24 473/297

(Continued)

*Primary Examiner* — Stephen L Blau
(74) *Attorney, Agent, or Firm* — Brown Rudnick LLP; Mark S. Leonardo

(57) ABSTRACT

The invention generally relates to a grip for a golf club having a housing portion specifically for housing an accessory, the grip specifically configured to enhance performance and enjoyment of the game of golf. Grips of the invention help to provide a smoother gripping surface and to prevent relative motion between the accessory and the club when the accessory is coupled to the club.

12 Claims, 12 Drawing Sheets

(56) References Cited

U.S. PATENT DOCUMENTS

| | | | | |
|---|---|---|---|---|
| 7,909,705 | B2 * | 3/2011 | Gill | A01K 87/08 473/297 |
| 8,888,606 | B2 * | 11/2014 | Boccieri | A63B 53/145 473/297 |
| 9,463,363 | B2 * | 10/2016 | Dingman | A63B 53/14 |
| 9,827,470 | B2 * | 11/2017 | Knutson | A63B 21/08 |
| 2006/0025230 | A1 * | 2/2006 | Zeuch | A63B 53/14 473/286 |
| 2006/0142093 | A1 * | 6/2006 | Moriyama | A63B 53/00 473/292 |
| 2011/0124431 | A1 * | 5/2011 | Karube | A63B 53/14 473/300 |
| 2014/0221121 | A1 * | 8/2014 | Margoles | A63B 53/145 473/297 |
| 2015/0045136 | A1 * | 2/2015 | Boccieri | A63B 60/24 473/297 |
| 2015/0251063 | A1 * | 9/2015 | Dingman | A63B 53/14 473/297 |

* cited by examiner

GOLF CLUB GRIP

FIELD OF THE INVENTION

The invention relates to golf clubs, more particularly to golf club grips.

BACKGROUND

Golf is a popular sport played with a club that generally has a head, a shaft, and a grip. Some golfers like accessories such as various sensors and other technologies that enhance their performance and/or enjoyment of the game. Thus, some golf clubs are provided with accessories which are housed within the grip of the club.

When an accessory is incorporated within a grip of a club, the manner in which the accessory is incorporated can make a difference in the feel to the golfer and/or the performance of the golfer. For example, the impact of the club with the ball could result in movement of the accessory within the grip, which can affect the golfer's performance and/or feel of the golf club. Additionally, depending on the type of accessory that is provided to the grip, such as a sensor for tracking an aspect of performance, the movement of the accessory within the grip could negatively affect the ability of the accessory to properly acquire/analyze data.

One recurring problem is that placing an accessory within a grip sometimes causes an undesirable deformation of the grip, such as a bulge around the grip, that distracts the golfer and causes the golfer to think that the grip feels awkward and uncomfortable.

SUMMARY

The present invention provides for a golf club grip having a housing portion specifically for housing an accessory, wherein the grip is specifically configured to enhance performance and enjoyment of the game of golf. Grips of the invention help to provide a smoother gripping surface and to prevent relative motion between the accessory and the club when the accessory is coupled to the club.

Preferred embodiments provide a grip for a golf club in which an internal bore for receiving a golf club shaft is flared, or increases in diameter, as the internal bore approaches a butt end of the grip. When such a grip is placed on a golf club with an accessory inserted into a recess within the grip, the flared area of removed material—relative to a prior art grip—avoids the awkward bulge that otherwise results from inclusion of the accessory.

In order to reduce the bulging and deformation that may occur in the butt end of the grip when an accessory is housed within a grip, the circumference of at least a portion of the internal bore is designed to decrease in a direction from the first end to the second end. In this way the circumference of the internal bore is larger toward the butt end of the grip, which helps to provide a consistent taper on the outer dimension of the grip, reduce grip to shaft interference, and remove bulging that may occur.

In certain embodiments, only a portion of the internal bore has a decreasing circumference. In other embodiments, the internal bore gradually tapers all the way from the first end to the second end.

In addition to the decreasing circumference of the internal bore, as noted above, the outer dimension is usually tapered. In certain embodiments, the outer dimension gradually tapers from the housing portion down to the shaft opening. Depending on the taper of the outer dimension and the circumference of the internal bore, the distance between the outer dimension and the inner dimension at any two cross sections taken along a plane perpendicular to a longitudinal axis of the grip can vary. For example, in one embodiment, the distance between the outer dimension and the inner dimension at any two cross sections taken along a plane perpendicular to a longitudinal axis of the grip at any point where the circumference of the internal bore decreases is substantially equal. In yet another embodiment, the distance between the outer dimension and the inner dimension taken at a first cross section along a first plane perpendicular to a longitudinal axis of the grip at the first end is smaller than the distance between the outer dimension and the inner dimension taken at a second cross section along a second plane perpendicular to the longitudinal axis at a point along the decreasing circumference of the internal bore that is distal to the first end.

The housing portion can be formed as a continuation of the sleeve member or can be a separate piece that is coupled to the sleeve member. In a preferred embodiment, the housing portion is formed as a continuation of the sleeve member. In certain aspects the housing portion defines a recess with an open end at the proximal end of the grip for receiving the accessory. A flange separating the housing portion from the internal bore can also be provided. In some embodiments a hole extends through the flange, the hole capable of receiving a portion of the accessory therethrough. For example, the accessory can comprise a main body and a stem, with at least a portion of the stem extending through the hole.

In addition to, or as an alternative to, providing a tapered internal bore with a decreasing circumference, in certain embodiments, the grip includes a region or panel of harder material positioned along the inner dimension toward the first end. This additional material will have a durometer that is higher than a durometer the rest of the grip. In certain embodiments, the grip also includes an end cap at the proximal end of the grip, wherein the end cap has a durometer substantially equal to the durometer of the additional material.

The panel length can be described with respect to the length of the internal bore as measured from the first end to the second end. In one embodiment, the panel has a length that is less than 50% of the length of the internal bore. In certain embodiments, the panel has a length that is less than 30% of the length of the internal bore.

Generally, the additional material has a first side facing the outer dimension and a second side facing the internal bore. In certain embodiments, the second side is flush with the inner dimension of the sleeve member. In these embodiments, the thickness of the panel can be described with respect to the distance between the inner dimension and the outer dimension. For example, in certain aspects, the panel has a thickness greater than 10% of a distance between the inner dimension and the outer dimension. In other aspects, the panel has a thickness greater than 25% of the distance between the inner dimension and the outer dimension.

Furthermore, in addition or alternative to providing an internal bore with a decreasing circumference and/or adding a panel of higher durometer material to the sleeve member, in certain embodiments, the accessory to be housed within the recess of the housing portion is configured to include a main body having circular cross sections, a top end positioned at the proximal end of the grip, a bottom end, and side walls that taper from the top end to the bottom end. The accessory will have a largest radius toward the top end that is greater than an internal radius of the recess, such that an interference fit between the accessory and an internal surface of the recess is created. The interference fit will help to reduce movement of the accessory within the grip and can also help to create a consistent taper on the outer dimension, both of which help to improve the feel of the club and performance by reducing discomfort and distraction, as well as reducing movement within the club during impact.

In certain embodiments, the largest radius of the accessory is about 2% greater than the internal radius of the recess. In other embodiments, the largest radius of the accessory is about 5% greater than the internal radius of the recess. In still other embodiments, the largest radius of the accessory is about 10% greater than the internal radius of the recess.

In certain aspects, the accessory also includes a stem extending from the bottom end of the main body. In certain embodiments, at least a portion of the stem extends through the hole in the flange when the accessory is housed within the recess of the housing portion. The stem can include one or more protrusions extending outward perpendicularly from a longitudinal axis of the grip. The protrusions are to be spaced apart from the main body of the accessory by at least a distance equal to or greater than the thickness of the flange. In this way, when the accessory, such as an electronic device with, e.g., one or more of a sensor, battery, chip, etc., is inserted into the recess with the stem extending through the hole, the main body of the accessory is on one side of the flange and the protrusions are on the other side such that the protrusions help to prevent the accessory from falling out of the hole.

In yet another embodiment, the grip includes a retaining member housed within the housing portion and in seated communication with the accessory such that the retaining member is positioned between the accessory and the open end. The retaining member will have a protrusion that extends into an indentation, or slot, within the internal surface of the recess, thus locking the retaining member in place within the housing while also securing the accessory within the grip. In certain aspects, the retaining member comprises a material, such as rubber, that deforms when subjected to pressure. In some embodiments, the retaining member comprises an annular shape.

DETAILED DESCRIPTION

The invention generally provides a golf club grip configured to house an accessory. The grip is specifically configured to enhance performance and enjoyment of the game of golf, such as by providing a smoother gripping surface and preventing relative motion between the accessory and the club when the accessory is coupled to the club.

Figure 1:
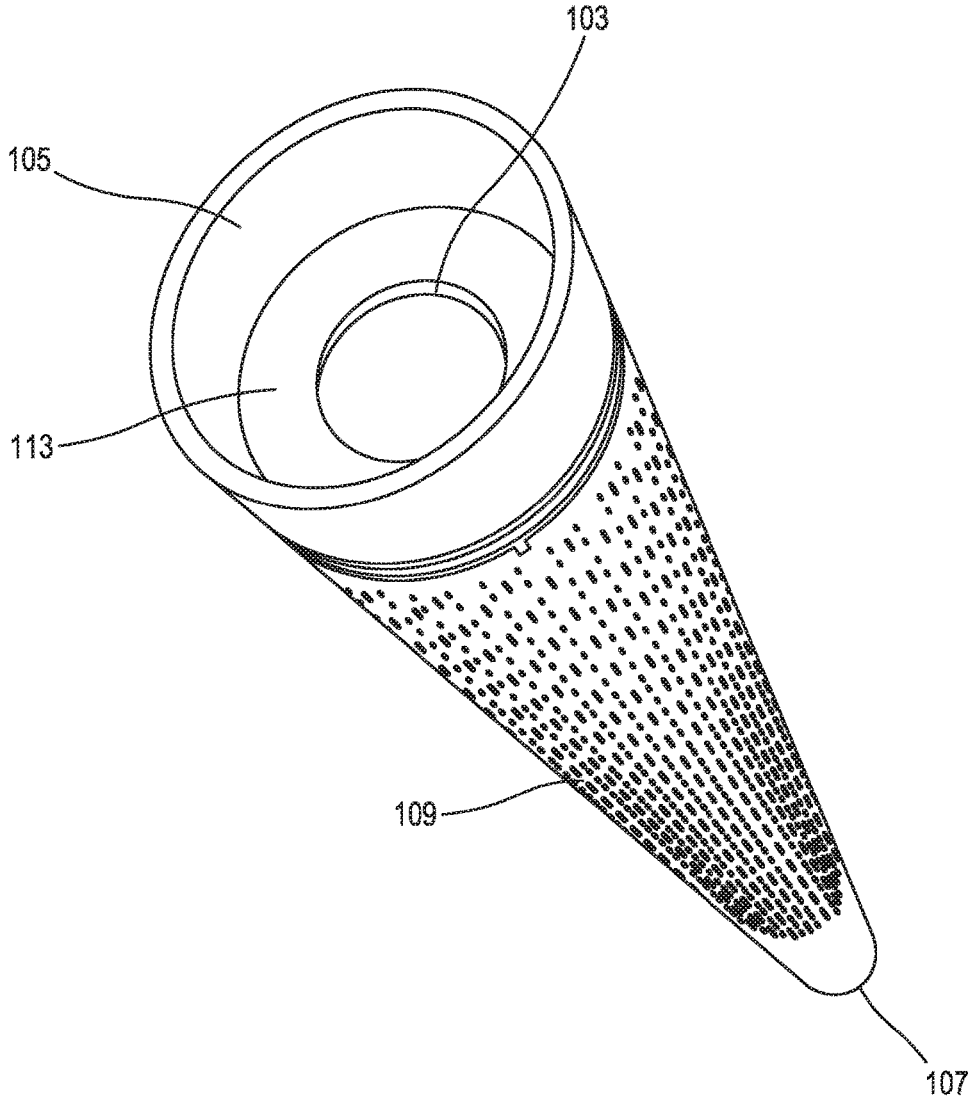
FIG. 1 shows a grip with conic internal bore.

FIG. 1 shows a grip 101 for a golf club having a sleeve member 109 with a gripping surface, a shaft opening 107, and a housing portion 105 at the butt end 115 of the grip configured to house an accessory. Flange 113 generally separates an internal bore for receiving a shaft from housing portion 105. Flange 113 may define hole 103, which can be configured to receive part of an accessory (not pictured in FIG. 1). Flange 113 around the bottom of the housing portion of the grip can act as a stopper so that the shaft does not extend into the housing portion and does not make contact with the main body of the accessory when installed in the grip. The housing portion 105 can be formed as a continuation of the sleeve member 109 or can be a separate piece that is coupled to the sleeve member 109. In a preferred embodiment, the housing portion 105 is formed as a continuation of the sleeve member 109.

Preferably, sleeve member 109 provides a golfer with a good grip on the club.

The sleeve member 109 can include textured portions, which can be ridges, valleys, knobs, divots, irregular protrusions or recesses, or any other suitable method of providing a gripping surface. Material of the grip can also be made tacky, for instance by choosing a soft rubber, polymer, or composite or by impregnating a primary material with a secondary compound. The sleeve member 109 also has an outer dimension (OD) and an inner dimension (ID).

Figure 2:
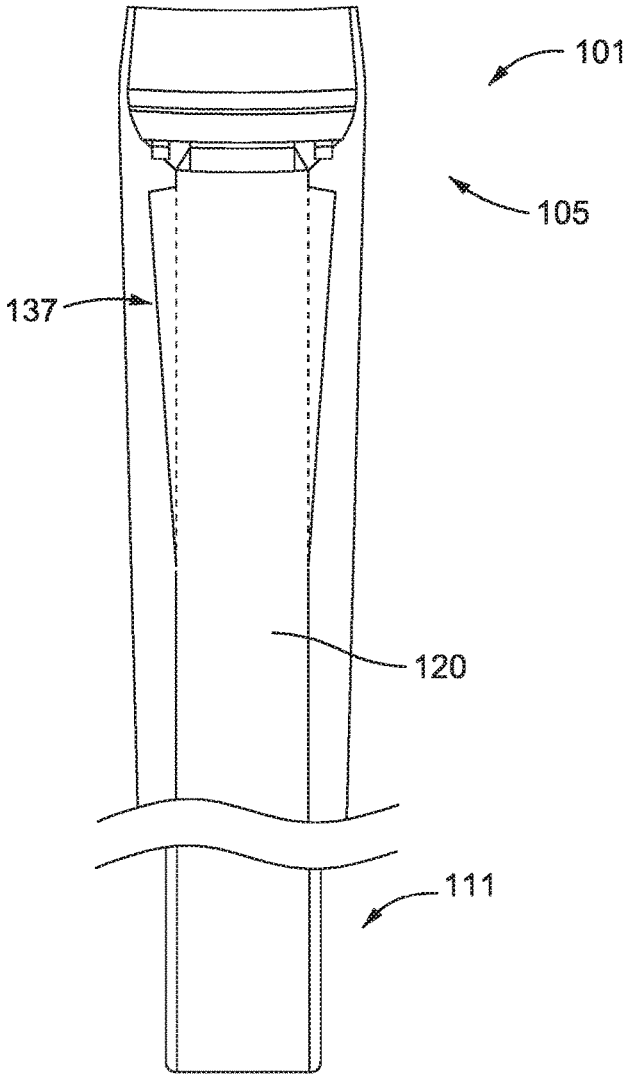
FIG. 2 is a close-up, cross-sectional view through a portion of the grip.
Figure 3:
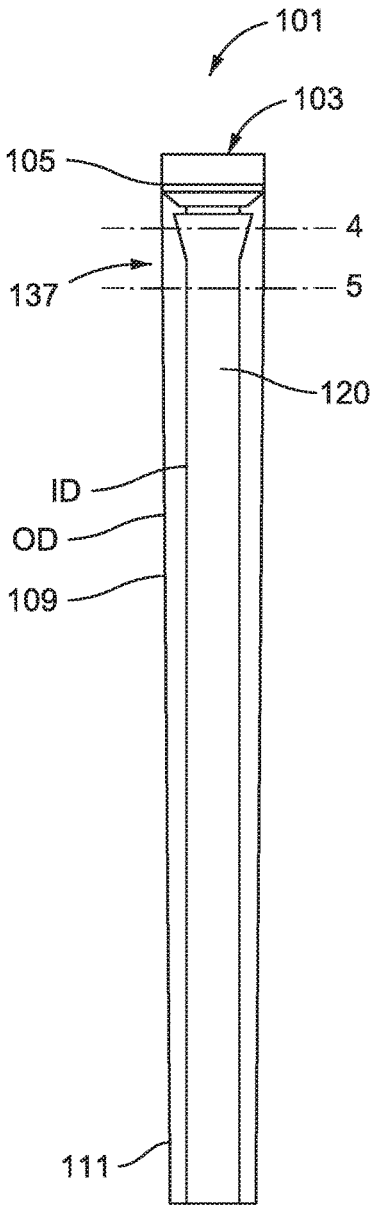
FIG. 3 is a cross-sectional view along the grip.

FIG. 2 is a close-up, cross-sectional view through a portion of the grip 101. The ID can gradually taper from the housing portion 105 down to the distal portion 111, as shown in FIG. 3. The flared, or tapered, portion of the inner bore 120 creates a conic region 137 at which the inner bore is not cylindrical. Dashed lines in FIG. 2 do not form part of the grip 101 and instead are drawn only to show what would be a smooth, cylindrical continuation of the inner bore 131 similar to what is found on standard prior art grips.

Figure 4:
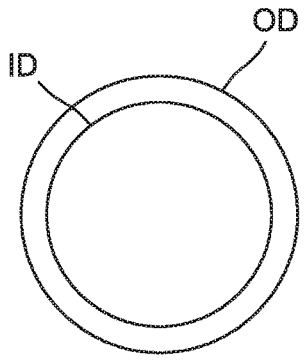
FIG. 4 is a cross-sectional across a butt-end of the grip.

It is also to be understood that the OD and/or the ID can vary in any manner throughout the sleeve member such that the distance between the OD and the ID varies depending on which perpendicular plane the measurements are taken. For example, in one embodiment, the ID of the internal bore 120 toward the butt end 115 can flare, reducing the distance between the ID and the OD, as shown in FIG. 4. It is also contemplated that the distance between the OD and the ID can vary at any point along the same perpendicular plane, as shown in FIG. 5.

FIG. 3 is a cross-sectional view along the grip 101. As shown, the conical portion 137 is adjacent the butt-end of the grip 101. By having some material "removed" (relative to a prior art grip with cylindrical bore), the grip 101 performs better when an accessory is inserted into the recess 103 provided by the housing 105. Cross-sectional views illustrate the conical portion 137 provided by the flared shape within the inner bore 120

FIG. 4 is a cross-sectional across through the grip 101 along line 4 in FIG. 3, near a butt-end of the grip 101.

Figure 5:
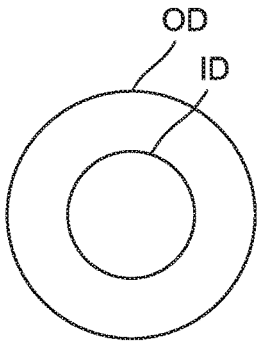
FIG. 5 is a cross-sectional across the grip.

FIG. 5 is a cross-sectional across through the grip 101 along line 5. It can be seen that the inner diameter increases along the conical portion 137 approaching a butt end of the grip 101. It has been found that placing an accessory into a prior art grip causes certain problems; prior art grips bulge outwards slightly when an accessory is pushed into a recess in the prior art grip. The invention includes molding a grip 101 with a conical flared portion 137 along a butt end of an internal bore 120, which flared internal bore relieves and avoids the slight bulge associated with insertion of the accessory into a prior art grip.

Figure 6:
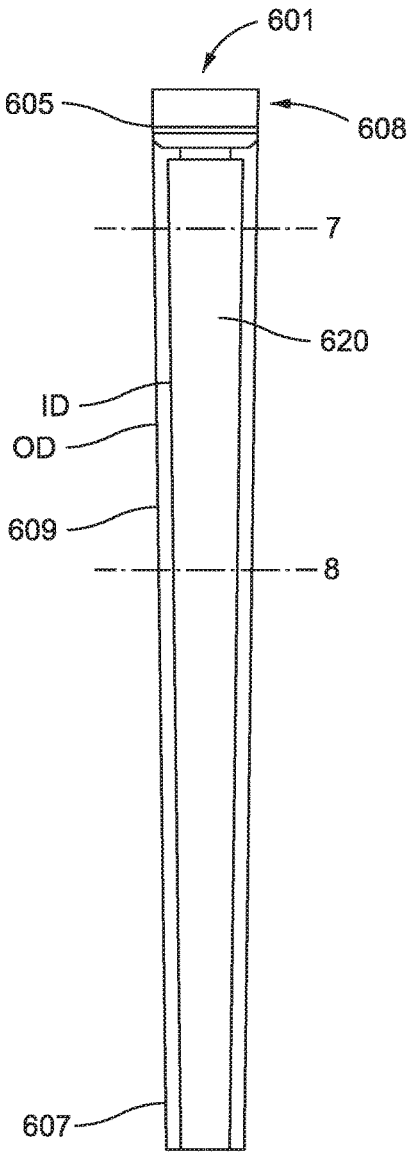
FIG. 6 is a cross-sectional view along a constant taper grip.

In yet another embodiment (not shown), both the OD and the circumference of the internal bore can flare to the same degree toward the butt end 115, such that the distance between the ID and the OD remains essentially the same, similar to FIG. 6.

The internal bore 130 can be formed using any manufacturing methods known in the art. For example, a core bar having a desired shape can be provided, around which the grip is formed, such that the ID of the internal bore 120 is consistent with the outer dimensions of the core bar used to form the grip. In one embodiment, the core bar has a substantially cylindrical shape, such that the ID of the internal bore 120 remains constant from the housing portion 105 to the distal portion. In another embodiment, the core bar has a tapered shape, such that the ID of the internal bore 620 gradually tapers, as shown in FIG. 6. In yet another embodiment, the core bar has a flared shape towards the housing portion 105, such that the ID of the internal bore 120 also flares, as shown in FIG. 3.

While a flared internal bore near the butt-end relieves the grip 101 from bulging when the accessory is inserted, other configurations may serve such as, for example, a flared conical bore along a length of the grip.

FIG. 6 is a cross-sectional view along a constant-internal taper grip 601. The grip 601 has an internal bore 620 along the sleeve member 609. The grip 601 also includes a housing 605 providing a recess to house an accessory. The internal bore 620 is substantially conic in that it tapers continually from a butt end 608 of the grip 601 to a distal end 607. Cross-sectional views aid in illustrating the conic taper.

Figure 7:
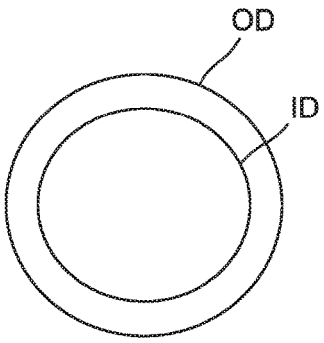
FIG. 7 shows a cross section view across a butt portion of the constant taper grip.

FIG. 7 shows a cross section view across grip 601 taken at line 7.

Figure 8:
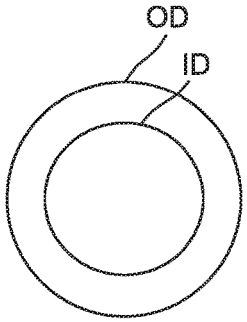
FIG. 8 shows a cross section view across a mid-portion of the constant taper grip.

FIG. 8 shows a cross section view across grip 601 taken at line 8. In grip 601, the consistent taper of both the OD and the ID helps to reduce any grip to shaft interference and/or removes bulging at the butt end of the grip that could arise with a prior art grip when an accessory is used.

While a flared internal bore relieves the grip 101 from bulging when the accessory is inserted, other features may be included or used additionally or alternatively to also prevent the bulge.

Grips according to the present disclosure can have a constant or variable hardness. In grips made from rubber and/or plastic, this hardness is often measured and expressed in durometers, which is typically defined as a material's resistance to indentation. In one embodiment, the grip can have a substantially constant hardness, accounting for any manufacturing variance, etc. In another embodiment, the grip can have varying hardness. For example, in one embodiment, the durometer at the butt end 115 of the grip, such as throughout the housing portion 105 and/or on an end cap, is higher than the durometer throughout most of the sleeve portion 109, especially towards the distal end 111.

Figure 9:
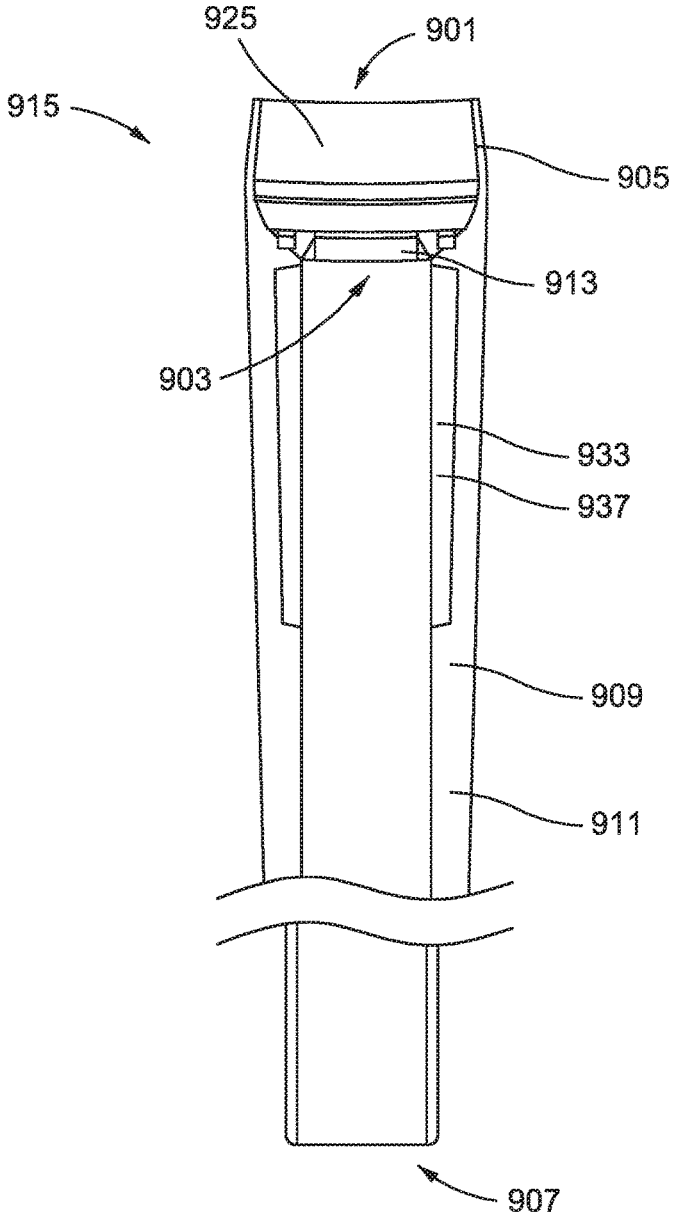
FIG. 9 shows a grip with a region of harder material

FIG. 9 shows a grip 901 that includes a sleeve member 909 with a gripping surface, a shaft opening 907, and a housing portion 905 at the butt end 915 of the grip configured to house an accessory. Flange 913 generally separates an internal bore for receiving a shaft from housing portion 905. The sleeve member 909 includes a first material 911. An outer surface of the sleeve member has a gripping surface. The housing 905 defines a recess configured to house an accessory at a proximal end of the sleeve member 909.

The grip 901 includes a region 933 of harder material 937 proximal to an inner surface of the sleeve member 909 and located closer to the recess 925 then to the shaft opening 907. The harder material 937 has a durometer that is higher than a durometer of the first material 911.

Flange 913 may define hole 903, which can be configured to receive part of an accessory. Flange 913 around the bottom of the housing portion of the grip can act as a stopper so that the shaft does not extend into the housing portion and does not make contact with the main body of the accessory when installed in the grip. The housing portion 905 can be formed as a continuation of the sleeve member 909 or can be a separate piece that is coupled to the sleeve member 909. In a preferred embodiment, the housing portion 905 is formed as a continuation of the sleeve member 909. In certain embodiments, the region 933 of harder material 937 has a length extending less than 50% of a length of the internal bore as measured from the first end to the second end.

The first material 911 and the harder material 937 may be different materials (e.g., different molding compounds) that are molded together such that the two materials essentially transition seamlessly from the first material 911 to the harder material 937, e.g., at the dotted lines shown defining the region 933. The first material 911 and the harder material 937 can be substantially the same material albeit with slightly different chemistries or curing time and temperature parameters. For example, both the first material 911 and the harder material 937 can be a rubber, latex, or silicon but the harder material 937 may be doped or impregnated with a compound that confers a harder durometer to the harder material 937 than a durometer of the first material 911.

In some embodiments, the region of harder material comprises a panel of a second material, distinct from the first material, disposed within the sleeve member.

Figure 10:
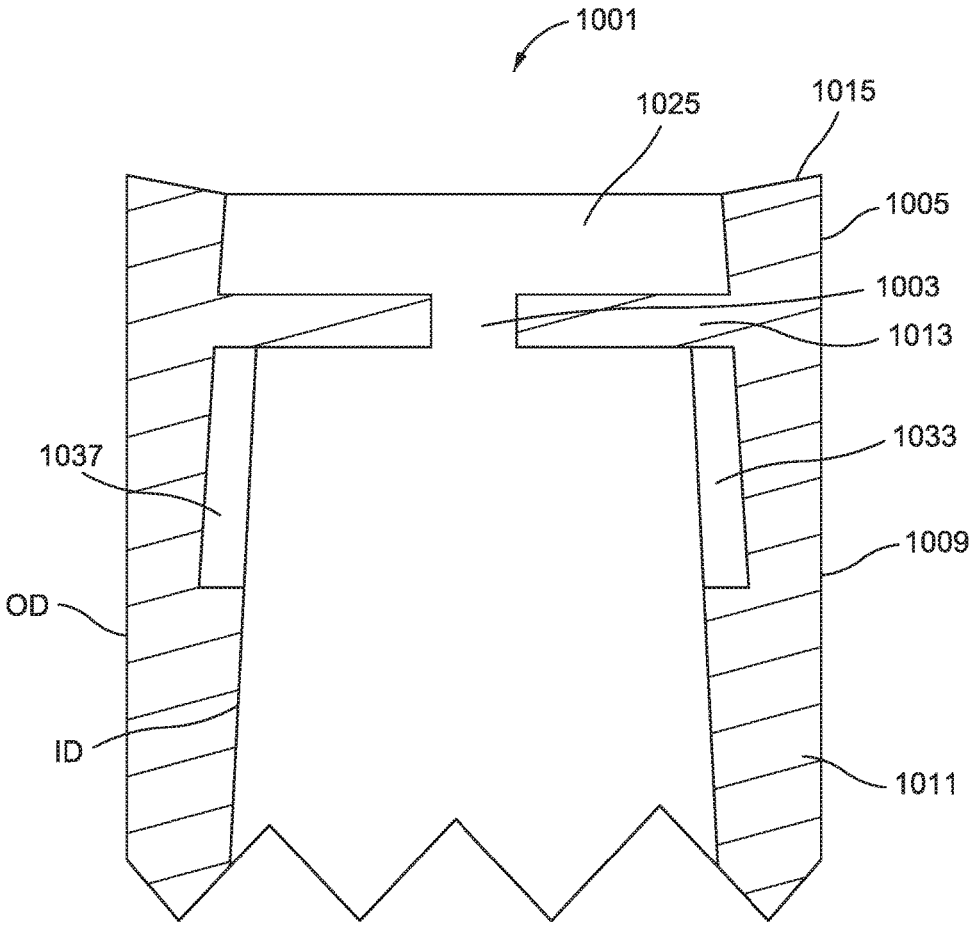
FIG. 10 shows a grip with a region of harder material as a discrete panel.

FIG. 10 shows a grip 1001 that includes a sleeve member 1009 with a gripping surface and a housing portion 1005 at the butt end 1015 of the grip configured to house an accessory. Flange 1013 generally separates an internal bore for receiving a shaft from housing portion 1005. The sleeve member 1009 includes a first material 1011. An outer surface of the sleeve member has a gripping surface. The housing 1005 defines a recess 1025 configured to house an accessory at a proximal end of the sleeve member 1009.

The grip 1001 includes a region of harder material 1037 provided as a discrete panel 1033. The panel 1033 of harder material 1037 is preferably proximal to an inner surface of the sleeve member 1009 and located closer to the recess 1025 then to the shaft opening. The harder material 1037 has a durometer that is higher than a durometer of the first material 1011.

Additional panels of higher durometer material may be added along the grip.

In the preferred embodiment, the panel 1033 of higher durometer material is disposed along the ID of the sleeve member 1009 toward the butt end 1015 of the grip 1001 abutting the flange 1013. In this embodiment, the butt end 1015 also has a higher durometer than the rest of the sleeve member 1009. By adding the panel 1033 of higher durometer material to the sleeve member 1009 toward the butt end 1015 of the grip, the stability of the club is improved when the club is gripped and swung. Additionally, the durometer of a material can also have an effect on an outer shape of the grip 1001.

The dimensions of the panel 1033 can vary in both length and thickness as desired to impart optimal performance, feel, and aesthetics. In some embodiments, the panel 1033 has a length extending less than the length of the internal bore as measured from the first end to the second end. For example, the length of the panel can extend less than 90%, 80%, 70%, 60%, 50%, 40%, 30%, 20%, or 10% the length of the internal bore.

The panel 1033 of additional material will have a first side that faces the outer dimension and a second side that faces the internal bore 120. The second side is preferably flush with the inner dimension of the sleeve member. Accordingly, the thickness can be described with respect to the distance between the ID and the OD. For example, the panel can have a thickness of greater than 10%, 20%, 25% 30%, 40% 50%, 60%, 70%, 75%, 80% or more of the distance between the inner dimension and the outer dimension.

The durometer of the sleeve member 109 distal to the housing portion, not including the panel 1033, will typically be in the range of about 35 to about 60 on the Shore "A" scale. The durometer of the butt end 115, such as the end cap, will fall within a higher range, such as between about 60 and about 100 on the Shore "A" scale. The additional panel 1033 will have a durometer that is higher than the sleeve portion. In some embodiments, the durometer of the additional material is substantially equal to the durometer of the butt end, accounting for any manufacturing variances, etc. In other embodiments, the durometer of the additional material is between the durometer of the sleeve member and the butt end.

The grip can be made of any material suitable for being held by a user. For example, the grip can be made with cord manufactured from cotton. Grips made from cord can be half or full corded. Grips can also be made of a rubber or plastic material. Some grips can be made from a blend of liquid rubber and granulated cork, optionally pressure molded, sanded, or painted. Grips can be made of plastics or polymer materials such as, for example, Ethylene Propylene Diene Monomer (EPDM). Grips can be made of leather such as cowhide, calfskin or kangaroo. They can be spiral wrapped. Corded grips can be corded with strands of thread, e.g., to create a non-slip "rain grip". A grip or a component of a grip according to the invention can be injection molded, compression molded, or a combination thereof. Examples of suitable materials or methods of making a grip are described in Golf Club Grip, U.S. Pub. 2007/0072696.

The invention provides grips for use with any golf club including, for example, drivers, irons, hybrids, wedges, and putters. For example, where the invention provides a putter grip with a housing, the grip can be tubular, tapered, a paddle style (with a flat area for the thumbs), a pistol style (with a protruding area), or any other style known in the art. A grip of the invention can be substantially evenly round or have a reminder (i.e., a line or rib on the grip that reminds the golfer where the hand should be placed).

A grip can be made to have a graphic, emblem, or marked area. A mark, graphic, or emblem can include an area of a different thickness or texture (e.g., a bas-relief), a pigment, a sticker, a medallion, or other indicator. Generally, such an indicator may be a corporate logo or other visible element, a reminder (e.g., tactile), or both. In some embodiments, a grip of the invention is designed to complement a club with a repositionable shaft. Exemplary club systems are described in Interchangeable Shaft System, U.S. Pub. 2009/0197694; Interchangeable Shaft System, U.S. Pub. 2009/0264214; Interchangeable Shaft System, U.S. Pat. No. 7,699,717; Interchangeable Shaft System, U.S. Pub. 2011/0143854; Interchangeable Shaft and Club Head Connection System, U.S. Pat. No. 7,878,921; Interchangeable Shaft and Club Head Connection System, U.S. Pub. 2010/0261543; Interchangeable Shaft and Club head Connection System, U.S. Pub. 2009/0247316; Quick Release Connection System for Golf Clubs, U.S. Pub. 2008/0125239; Two-Part Hosel Connection System for Golf Clubs, U.S. Pub. 2008/0254909; and Interchangeable Shaft for a Golf Club, U.S. Pat. No. 7,476,160, the contents of each of which are herein incorporated by reference in their entirety.

Clubs that include a shaft repositionable relative to a club head sometimes provide that the club head may be repositioned at different relative rotations around the shaft axis. In some embodiments, a grip according to the invention includes a graphic, an indicator, or a shape, such that an appearance of the club and grip to a spectator is substantially similar regardless of the effective head-shaft position. For example, where a head can be fixed on a shaft in three different positions, each defined by an angular offset from the others of 120 degrees, a grip of the invention can exhibit three-fold rotational symmetry, whereby a visible element of the grip is repeated to appear in three places, each offset from the others by a 120 degree angular offset. This way, regardless of an effective setting of the golf club, the club and grip appear the same, for example, on a camera recording the game of golf being played. That is, if the grip has a corporate logo on it designed to face forward from the golfer when the club is at address, the grip can have three such logos, so that one is always facing forward from the golfer when the club is at address. With or without a logo or any other graphic or other visible element, a grip according to the invention can be made a solid color, or a multi-color theme according to a pattern or an irregular mix (e.g., tie-dyed, marbled, or speckled).

With reference back to the housing portion of the grip, the housing portion 105 can hold a variety of objects (including, but not limited to electronics, weights, training devices, accessories). Preferably the interior housing portion of the grip is dimensioned properly to allow for expansion when shafted and still provide a tight fit around an object.

Pliable generally refers to a material that is easily flexible and resists fatigue. Natural rubber, synthetic rubber and compound materials can be used alone or in conjunction with a number of cord and surface configurations to offer a certain tactile, softness or gripping characteristics. Preferably, a grip includes a rubber or elastic material which can be bent down, but also which exerts force on an accessory, for example, by virtue of the tacky surface or the elastic or frictional properties of the material.

Whatever features, colors, materials, or contours are included, a grip may generally be described by its dimensions and other intrinsic properties. The housing portion of the grip can be described according to aspects of the recess formed therein. In some embodiments, the housing portion includes a generally cylindrical recess surrounded by a generally tubular wall. The "depth" of the recess can be described by measuring a length of the recess (or the surrounding wall) in a direction generally parallel to a shaft axis (e.g., longitudinal axis of the grip), if the grip were installed on a club. The size of the recess may also be described by reference to an internal radius (e.g., of the surrounding wall), measured in a direction perpendicular to the longitudinal axis. The housing may further be described with reference to a measurement of an external radius of the surrounding wall. A thickness of the wall may be described by a difference of the internal and the external radius.

In some embodiments, a length or an internal radius of the recess is between about 6 and about 26 mm. The external radius may be between about 8 mm and about 30 mm. Generally, the length of the wall (i.e., the length of the recess) may be greater than about 9 mm. In preferred embodiments, a length of the recess is between about 8 mm and about 13 mm; an internal radius is between about 10.5 mm and about 14.5 mm; an external radius is between about 11.5 mm and about 19.5 mm; or any combination thereof. In certain embodiments, the length of the recess may be about 11.5 mm, the internal radius may be about 12.5 mm, the thickness of the wall may be about 2 mm, the maximum length of the grip may be about 27 cm, or any combination thereof.

Generally, the grip may have a mass between about 40 grams and about 55 grams, or between about 15 grams and about 70 grams. Preferably, the grip has a mass between about 44 grams and about 53 grams. In certain embodiments, the mass is between about 48 grams and about 52 grams.

In some embodiments, the grip may be scaled up, or scaled down (e.g., for a club for a younger person or very tall person, or for a mini or outsized model club or grip for display as a demonstration) and proportions of the grip may then generally be described by reference to ratios that do not have units. In some embodiments, a ratio of a length of the recess to a thickness of the wall is greater than four and may be between about 5 and about 7. In some embodiments, a ratio of a length of the recess to a thickness of the wall is between about 5.5 and about 6.5. Preferably, a ratio of the length of the recess to a thickness of the wall is at least about 2.5 or about 3. In some embodiments, a ratio of a length of the recess to an internal or external radius of the recess is between about 7 and about 2.5, and may preferably be between about 8 and about 1.5. Generally, a ratio of an external radius of the recess to an overall length of the grip may be between about 0.02 and about 0.12, and may be between about 0.03 and about 0.09. Preferably, a ratio of an external radius of the recess to an overall length of the grip may be between about 0.05 and about 0.06. Generally, a ratio of a length of the recess to an overall length of the grip may be between about 0.01 and about 0.09, and may preferably be between about 0.02 and 0.07. In some embodiments, a ratio of a length of the recess to an overall length of the grip may be between about 0.035 and 0.05.

A grip of the invention generally may have any mass depending on its scale and size. In some embodiments, a grip of the invention has a mass between about 10 grams to about 70 grams, preferably between about 30 grams and about 60 grams. In a preferred embodiment, a grip has a mass of between about 40 grams and about 55 grams, preferably between about 51 and about 53 grams.

In certain aspects, the invention provides a grip and an accessory 201.

Figure 11:
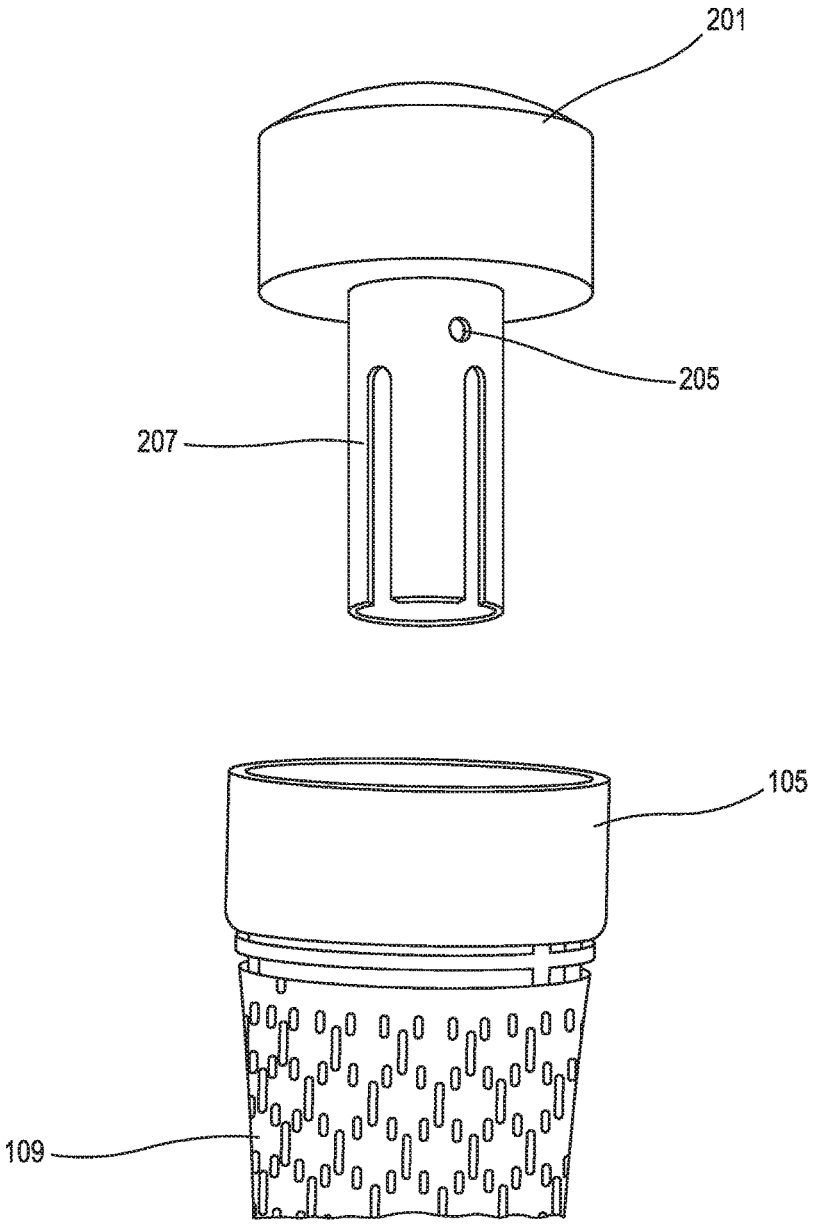
FIG. 11 shows an accessory for use with a grip of the disclosure.

FIG. 11 shows accessory 201, in accordance with one embodiment, having a main body 203 and a stem 205 partially inserted to a club shaft near an inside-out housing 105 at the end of sleeve member 109. One or more of cutout 207 can be provided in stem 205 allowing stem 205 to be squeezed to have a smaller circumference at least at part of its length (e.g., during insertion), thereby allowing accessory 201 to be coupled to the golf club substantially by an expansive force—the force exhibited in an outward direction generally perpendicular to the shaft axis by the "legs" of stem 205, due to its being squeezed into the golf club shaft. It is also understood that the accessory could also have no stem.

Figure 12:
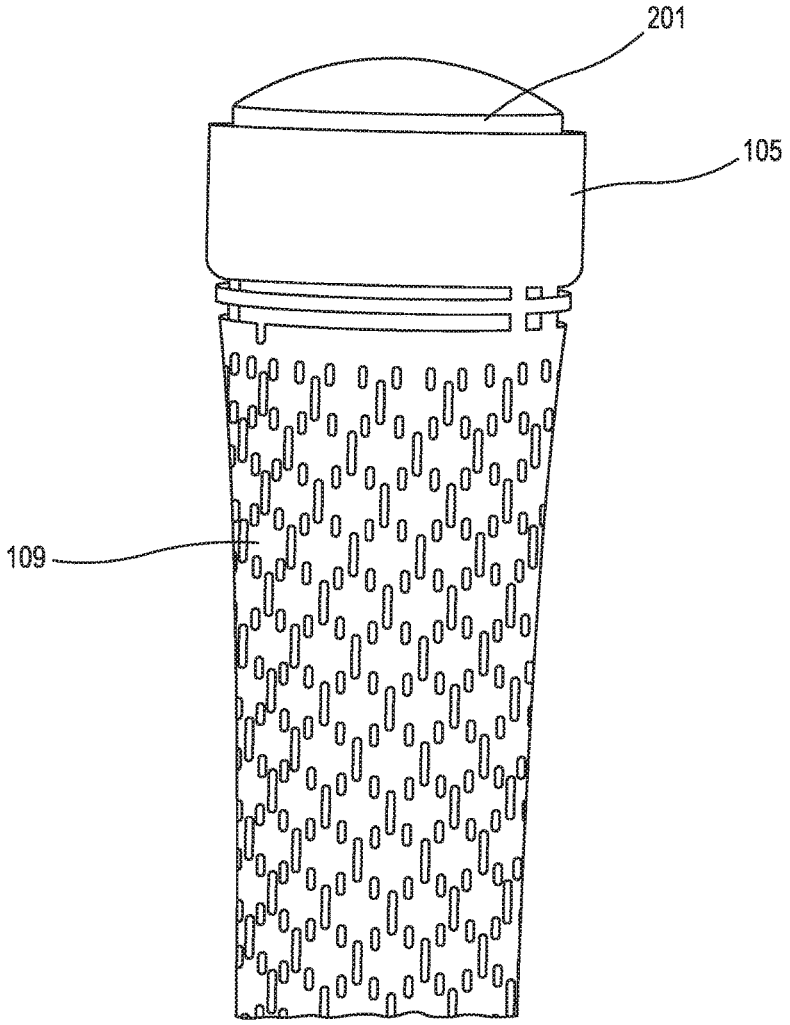
FIG. 12 shows the accessory positioned in the grip.

FIG. 12 shows the accessory 201 is fully positioned in the grip. Due to elastic properties, dimensions, and surface properties, motion of accessory 201 relative to the club is prevented.

Due, at least in part, to the contact of housing 105 on accessory 201, the grip exerts forces on accessory 201 that resist motion. When housed, accessory 201 is prevented from moving relative to a golf club in any of a number of modes including twisting, rotation, revolution, swiveling, shearing, longitudinal, or any combination thereof. This phenomenon relates to the coupling of an interior surface of housing 105 to an exterior surface of the accessory 201. By matingly coupling—that is, substantially matching and complementing each other in dimensions—surface contact creates much of the desired force. Accordingly, a grip of the invention provides the beneficial result that relative motion between the accessory and the club is prevented during play, which includes restricting such motion to less than fractions of a millimeter in any relevant direction. In some embodiments, when a club is played, a coupled accessory moves less than about a tenth or a quarter of a millimeter relative to the club and, due to elastic properties of the grip, returns to its relative original position.

Figure 13:
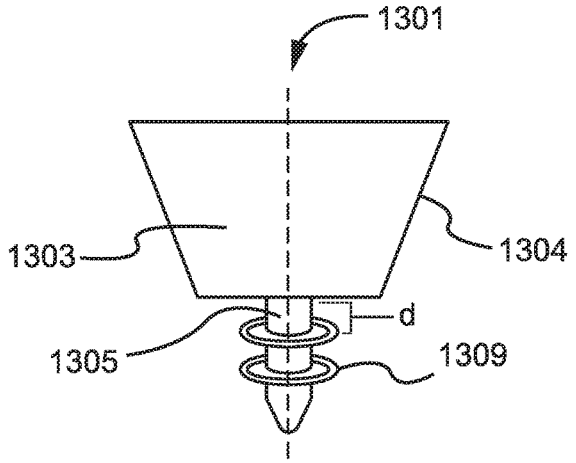
FIG. 13 shows an accessory with a locking stem.

FIG. 13 shows an accessory 1301 for insertion into the club at the butt end 115 of the grip has tapered side walls 1304. The accessory 1301 generally includes a main body 1303 and a stem 1305. As shown, the side walls 1304 of the accessory taper from the top end of the main body 1303 toward the bottom end. The 1305 presents one or more protrusions 1309 extending outward. The stem is to be inserted into the hole 103. The protrusions should extend outward from the stem 1305 in a direction perpendicular to the longitudinal axis and to a point that extends beyond the radius of the hole 103. The protrusions 1309 are also spaced along the stem 1305, starting at a predetermined distance d away from the point at which the stem 1305 extends downward from the main body 1303 of the accessory 1301. The predetermined distance d should be equal to or greater than the thickness of the flange 113. In this manner, once the accessory is inserted into the recess 130 with the stem 1305 extending through the hole 103, the protrusions 1309 help to prevent the accessory 201 from becoming dislodged from the recess 130 by abutting the bottom surface of flange 113.

Figure 14:
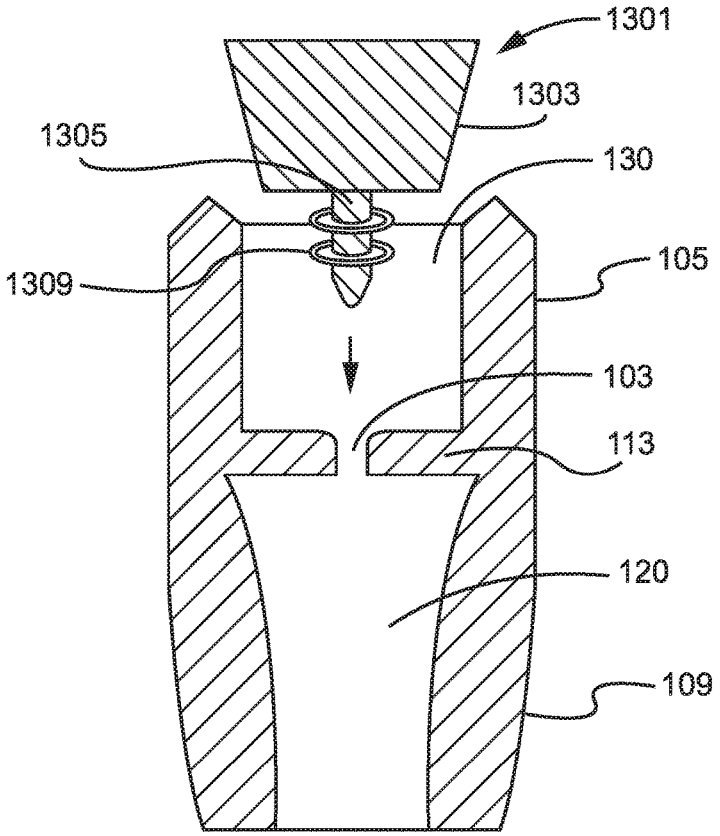
FIG. 14 shows insertion of the locking-stem accessory into the grip.

FIG. 14 shows insertion of the accessory 1301 into the recess 130 of the grip, such that the largest radius of the accessory 1301 is positioned closest to the butt end 115 of the grip.

The taper of the side walls 1304 of the accessory 201, in conjunction with straight walls forming the inside of the recess 130 within which the accessory 1301 is to be inserted, provides an interference fit. An interference fit is typically defined as a fit between two parts in which the external dimension of one part slightly exceeds the internal dimension of the part into which it fits. Here, the top end of the accessory 1301 with the largest radius is to have a radius that slightly exceeds the internal radius of the recess 130. In this way, once the accessory 1301 has been inserted into the recess 130, a secure, tight fit is provided. Additionally, because part of the accessory 1301 exceeds the internal radius of the recess 130, the part of the accessory 201 exceeding the internal radius pushes out on the walls of the recess 130 once inserted, creating a taper or flare on the outer dimension of the grip.

The protrusions 1309 on an accessory 1301 can have any shape that is suitable for allowing the accessory 1301 to be inserted through the hole 103, yet helps prevent the accessory 1301 from falling out of the recess 130 once inserted. In certain embodiments, the protrusions 1309 have a rounded shape at the outer edges to allow for easier insertion into the hole 103, such as, for example, a ring shape, nub, or rod shape having rounded edges. The accessory can have any number of the same or different protrusions 1309. For example, an accessory could have one, two, three, four, five, six, seven, eight, nine, ten, or more protrusions. The protrusions can have any width, breadth, or dimensions as would be recognized as suitable by one of skill in the art. The protrusions 1309 can be any material that is flexible/pliable, such as a rubber/elastomeric, plastic, composite, etc. material that allows for the deformation of the protrusions to facilitate insertion past the flange 113.

In yet other embodiments (not shown), the protrusion(s) 1309 is retractable when a force is exerted on it from one direction, such that the protrusion retracts into the stem upon pressure from the flange when being inserted into the recess, but then extends outward and locks in place once inserted past the flange.

In some embodiments an outside wall of housing portion 105 will have a slight "reverse taper" to more tightly grip accessory 1301, thereby preventing or inhibiting relative motion. Reverse taper generally refers to a tapering in a direction opposite of tapering of sleeve member 109. The outside wall can taper in by an amount between about 2° and about 8°, preferably about 5°.

Figure 15:
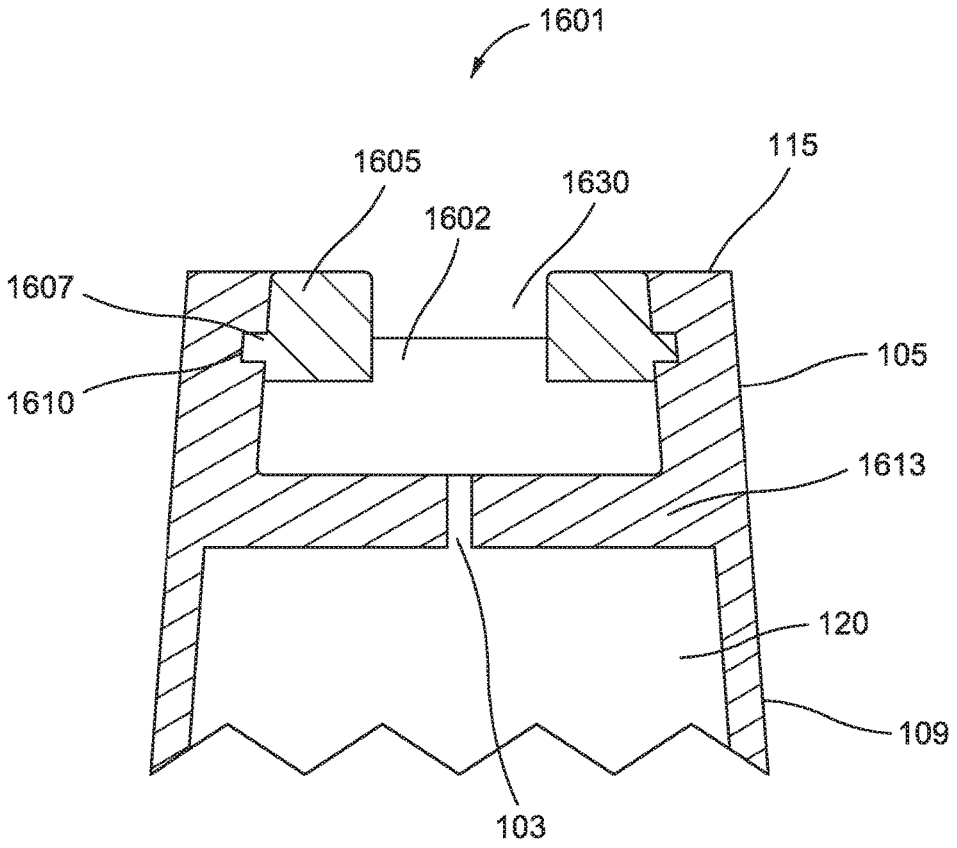
FIG. 15 shows a cut-away view of a grip with a retaining member.

FIG. 15 shows a cut-away view of a grip 1601 with a retaining member 1605. Here, an accessory 1602 is held in place within the recess of the grip by a retaining member 1605. The retaining member 1605 is configured to sit on top of the accessory 1602 once the accessory 1602 is inserted into the recess 1630 within the grip and is in sitting contact with the flange 1613. The retaining member 1605 can be made out of any material and may be malleable and/or flexible, such as for example, a rubber material. In certain circumstances, it can be difficult to insert the accessory into the recess 1630 and into a position in which the accessory will be held in place. By introducing a malleable and/or flexible retaining member to hold the accessory in place, the retaining member can be more easily deformed than the accessory when being pushed into position.

Additionally, in order to secure the accessory 1602 in place within the recess 1630, the retaining member 1605 is configured such that at least a portion of its outer dimension that comes in contact with the inner dimension of the recess 1630 extends radially into a slot 1610, such as a groove or notch, within the inner wall of the recess 1630. The retaining member 1605 can have any general shape suitable to remain engaged with the inner wall of the recess 1630 and hold the accessory in place, such as a cylindrical, disk, donut, or annular shape. In certain embodiments, the shape and dimensions of the retaining member 1605 can be such that the entire thickness of the member 1605 fits into the retaining slot 1610 (not shown). In other embodiments, the thickness of the retaining member 1605 is greater than the height of the slot 1610. In this case, the retaining member will have at least one protrusion 1607 that radially extends into the retaining slot 1610.

The retaining member 1605 may be a flexible ring having an annular protrusion 1607 that can be deformed when inserted into the recess and then engage with the retaining slot 1610 within the recess wall to hold the mechanism and accessory in place. Additionally, accessory 1602 can be configured to have a raised middle portion that abuts the inside surface of the retaining member 1605, which can further help lock the accessory in place with the retaining member 1605. It is also understood that the accessory 1602 does not have to have a raised middle portion and can have any shape, such as a flat shape, for its top surface.

Figure 16:
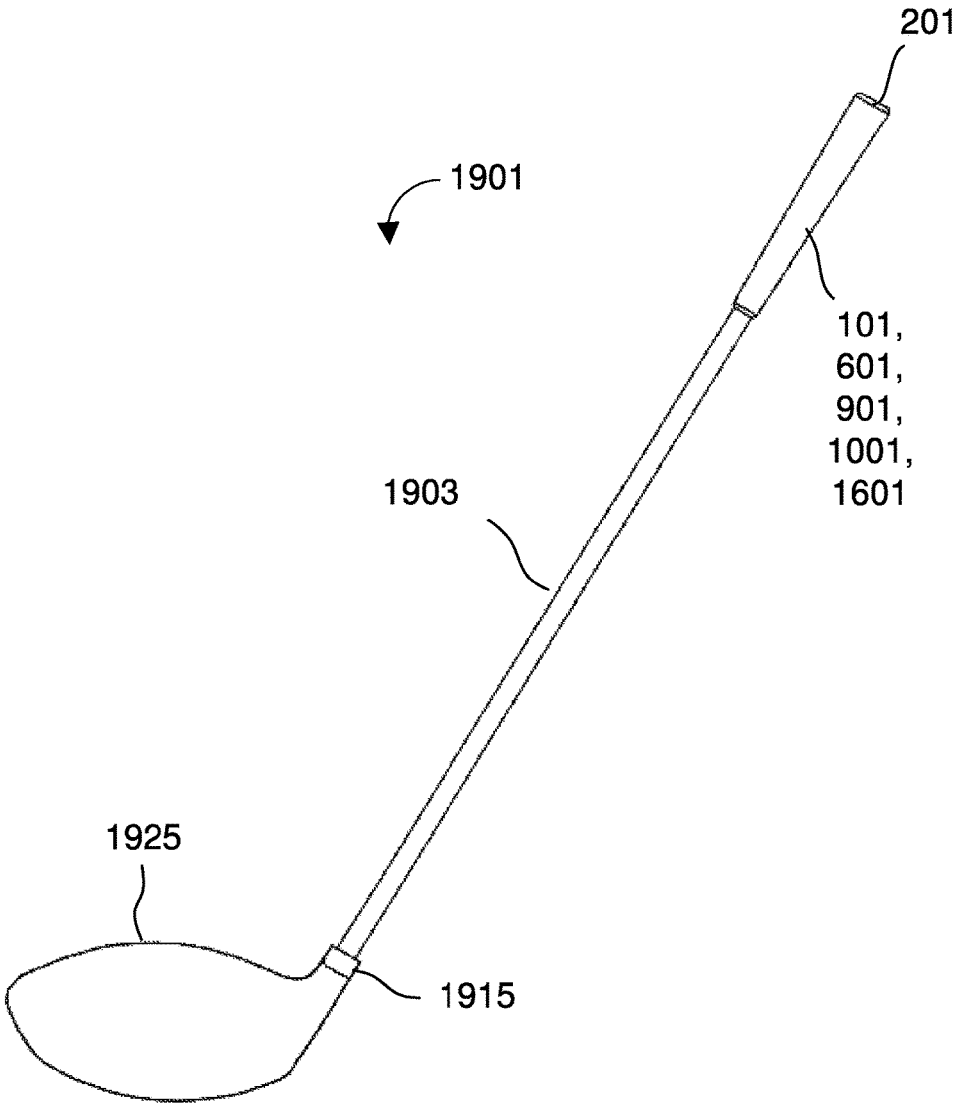
FIG. 16 shows a golf club with a grip

FIG. 16 shows a golf club 1901 that includes a club head 1925 with a shaft 1903 connected to the head 1925 via a hosel 1915 that extends upwards from the club head 1925 when the golf club 1901 is at address. A grip 101, 601, 901, 1001, 1601 is mounted on a proximal end of the shaft 1903, by insertion of the shaft 1903 into an inner bore of the grip 101, 601, 901, 1001, 1601. An accessory 201 is disposed within a recess with the grip 101, 601, 901, 1001, 1601. Embodiments of the invention provide the golf club 1901 or a kit comprising a grip 101, 601, 901, 1001, 1601 and the accessory 201. In certain embodiments, the invention provides a housing portion (either part of the grip or as a separate piece) that stabilizes an accessory relative to a club during play or a kit including such a housing portion and such an accessory. One exemplary accessory that can be stabilized by the grip with a housing portion of the present invention includes an orientation and time-sensing alarm as described in Orientation/Time Sensing Alarm Device For Golf Club, U.S. Pat. No. 6,753,778, incorporated by reference herein in its entirety. In some embodiments, provision of a housing portion allows the grip to house an electronic device that was previously only known to be containable within a shaft of the club (see, e.g., Golf Club Rhythmic Swing Meter, U.S. Pat. No. 6,517,352, incorporated by reference herein in its entirety) entirely or substantially (e.g., >than 60% of its volume) inside of the grip, and also substantially outside of the shaft of the club—providing for greater ease of interchangeability.

The accessory 201 can confer any number of desirable functions to golf clubs. In certain embodiments, accessory 201 includes one or more of a motion sensor, accelerometer, gyroscope, and light detector. A device can be included that detects or measures motion of the club in any one of, or any combination of, numerous modes including acceleration, translation motions, vibration, shock, tilt, and rotation.

The accessory 201 can offer a desired function such as swing improvement or training, situational on-off switching, or gesture recognition (e.g., two quick vertical shakes of a golf club signals an app on a golfer's smart phone to mark a position on a map for future reference). In some embodiments, the accessory 201 includes one or more of an accelerometer with low-g sensing ranges (e.g., roughly human generated), an accelerometer with high-g sensing ranges (e.g., roughly vehicle generated), a gyroscope, a multi-axis gyroscope unit, a multi-axis accelerometer unit, or a combination thereof.

Figure 17:
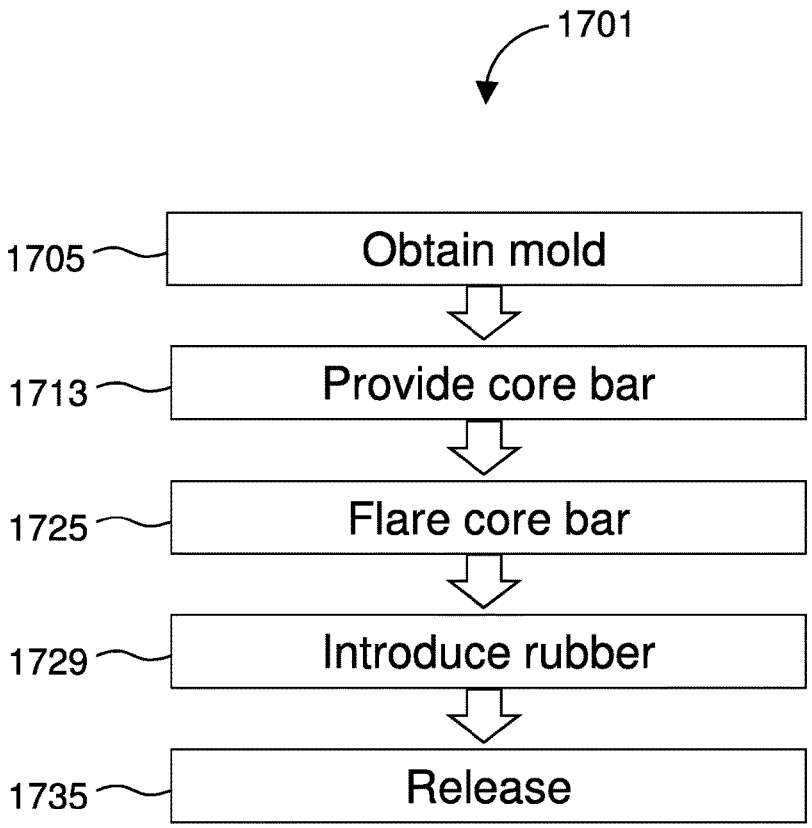
FIG. 17 diagrams a method of making a grip.

FIG. 17 diagrams a method 1701 of making a grip 101. The method 1701 includes obtaining 1705 a mold for a grip. Before making the grip, a core bar is provided 1713. Importantly to a preferred embodiment, the core bar is flared 1725 towards an end corresponding to a butt-end of the grip 101. The flared portion of the core bar will provide that the grip 101 has an internal bore that is at least partially conic, rather than entirely cylindrical. Rubber is introduced 1729 into the mold. After molding and any curing, the formed grip 101 is released 1735 from the mold.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A grip for a golf club, comprising:

a sleeve member having an outer dimension and an inner dimension;

a gripping surface;

a shaft opening at a distal end for receiving a shaft therein;

a housing portion configured to house an accessory at a proximal end; and an internal bore configured to receive the shaft, the internal bore forming the inner dimension of the sleeve member and having a first end that terminates at the housing portion and a second end that terminates at the shaft opening, the internal bore having a flared conical portion adjacent to the first end and a cylindrical portion between the conical portion and shaft opening, wherein a circumference of least a portion of the internal bore decreases in a direction from the first end to the second end, starting from the first end, wherein there is no step change in a circumference of internal bore between the flared conical portion and the second end, and with a circumference of the conical portion being greater than a circumference of the cylindrical portion.

2. The grip of claim 1 wherein the housing portion comprises a continuation of the sleeve member.

3. The grip of claim 2, wherein the housing portion defines a recess with an open end at the proximal end of the grip for receiving the accessory.

4. The grip of claim 3, further comprising a flange separating the housing portion from the internal bore.

5. The grip of claim 4, wherein the grip further comprises a hole that extends through the flange.

6. The grip of claim 5, wherein the accessory comprises a main body and a stem, and wherein at least a portion of the stem extends through the hole.

7. The grip of claim 3, wherein the accessory is positioned within the housing and comprises a main body having circular cross sections, a top end positioned at the proximal end of the grip, a bottom end, and side walls that taper from the top end to the bottom end.

8. The grip of claim 7, wherein the accessory further comprises a stem extending from the bottom end of the main body and one or more protrusions extending outward perpendicularly from a longitudinal axis of the grip.

9. A grip for a golf club comprising:

a sleeve member having an outer dimension and an inner dimension, a first end that terminates at a housing portion defining a recess with an open end at a proximal end of the grip, a second end that terminates at a shaft opening at a distal end for receiving a shaft therein, the inner dimension having a flared conical portion adjacent to the first end and a cylindrical portion between the conical portion and shaft opening, with a circumference of the conical portion being greater than a circumference of the cylindrical portion, wherein there is no step change in a circumference of internal bore between the flared conical portion and the second end;

a gripping surface;

an accessory housed within the housing portion, the accessory comprising:

a main body having circular cross sections, a top end positioned at the proximal end of the grip, a bottom end, and side walls that taper from the top end to the bottom end, wherein the accessory has a largest radius toward the top end that is greater than an internal radius of the recess, such that an interference fit between the accessory and an internal surface of the recess is created.

10. The grip of claim 9, wherein the largest radius of the accessory is about 2% greater than the internal radius of the recess.

11. The grip of claim 9, further comprising an internal bore configured to receive the shaft, the internal bore forming the inner dimension of the sleeve member and having a first end that terminates at the housing portion and a second end that terminates at the shaft opening, wherein a circumference of least a portion of the inner dimension decreases in a direction from the first end to the second end, starting from the first end.

12. The grip of claim 9, further comprising a flange separating the housing portion from the internal bore, wherein the grip further comprises a hole that extends through the flange, wherein the accessory comprises a main body and a stem, and wherein at least a portion of the stem extends through the hole when the accessory is housed within the housing portion, and wherein the stem comprises one or more protrusions extending outward perpendicularly from a longitudinal axis of the grip.

* * * * *